United States Patent [19]

Kirilloff et al.

[11] 4,146,868

[45] Mar. 27, 1979

[54] RESISTANCE UNIT STRUCTURE

[75] Inventors: Victor V. Kirilloff, Murrysville; William A. Benson, Pittsburgh, both of Pa.

[73] Assignee: Mosebach Manufacturing Company, Pittsburgh, Pa.

[21] Appl. No.: 882,178

[22] Filed: Feb. 28, 1978

[51] Int. Cl.[2] ..... H01C 7/22

[52] U.S. Cl. ..... 338/295; 338/58; 338/280; 338/315; 338/318

[58] Field of Search ..... 338/51, 57, 58, 279–281, 338/283, 210, 295, 315, 318–320; 219/375, 376, 381, 382, 353, 354, 532, 552, 553; 13/25

[56] References Cited

U.S. PATENT DOCUMENTS

| | | | |
|---|---|---|---|
| 1,472,138 | 10/1923 | Reid | 13/25 |
| 2,662,958 | 12/1953 | Flight et al. | 338/280 X |
| 3,212,045 | 10/1965 | Weyenberg | 338/316 |
| 3,214,572 | 10/1965 | Young | 338/280 X |
| 4,051,452 | 9/1977 | Luy | 338/280 X |

FOREIGN PATENT DOCUMENTS

| | | | |
|---|---|---|---|
| 252496 | 6/1926 | United Kingdom | 338/280 |

*Primary Examiner*—C. L. Albritton

*Attorney, Agent, or Firm*—Buell, Blenko & Ziesenheim

[57] ABSTRACT

The unit comprises a fan-folded ribbon of resistance material supported by parallel insulating members at the ends of the loops. Each length or fold is formed with a transverse reverse bend or offset dividing the fold into major and minor lengths, which are not coplanar.

5 Claims, 5 Drawing Figures

RESISTANCE UNIT STRUCTURE

This invention relates to the structure of high-current resistors. It is more particularly concerned with high-current resistors used for dynamic braking in electric locomotives.

Resistors used in dynamic braking are conventionally constructed of flat strip or ribbon of resistance material edge wound or folded back and forth into a series of flat loops between a pair of end support insulators. The adjoining lengths of a loop are, of course, spaced from each other. Ribbon so disposed is called "fan-folded." Each end of each fold or loop is supported but the remainder of the ribbon is exposed to the surrounding air so as to facilitate dissipation of heat. Several of the flat layers of ribbon wound as above described are frequently stacked one above the other and air is caused to flow through the stacked array by natural or forced draft. A resistance structure of the type above described is disclosed in Kirilloff U.S. Pat. No. 3,858,149 of Dec. 21, 1974.

Resistors for locomotive or other mobile service are necessarily subject to vibration. In addition the resistance ribbon expands when it is heated and most of the expansion takes place in the direction of its length, so causing the ribbon to slack off between support bends. If the ribbon expands sufficiently, vibration may cause adjoining slack lengths to short.

It is an object of our invention to provide a fan-folded resistance unit structure which minimizes lengthwise expansion of the ribbon sufficiently to avoid shorting between adjacent lengths conventionally spaced, or conversely to permit closer loop spacing. An unexpected bonus of our invention and, therefore, another object thereof, is to provide a fan-folded ribbon resistor structure with improved heat dissipation. Other objects of our invention will appear in the course of the description thereof which follows.

Our resistor structure comprises a fan-folded ribbon of resistance material supported by parallel insulating members at the ends of the loops. The lengths of ribbon between loops are not planar. Each length or fold is formed with a transverse reverse bend or offset dividing the fold into major and minor lengths, which are not coplanar. The reverse bends or offsets in adjoining lengths are not opposite each other.

An embodiment of our invention presently preferred by us is illustrated in the attached figures, to which reference is now made.

Figure 3:
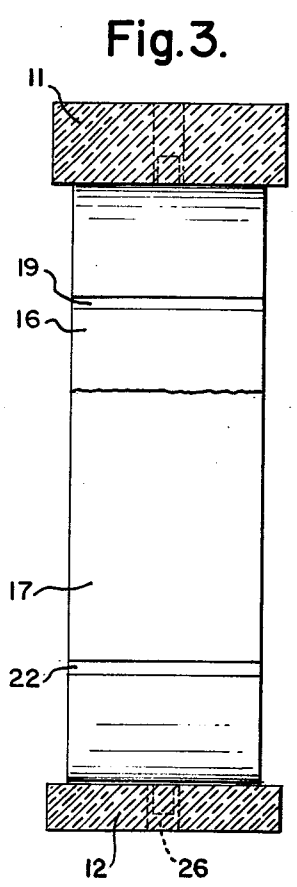
FIG. 3 is an end elevation of the detail of FIG. 2.
Figure 2:
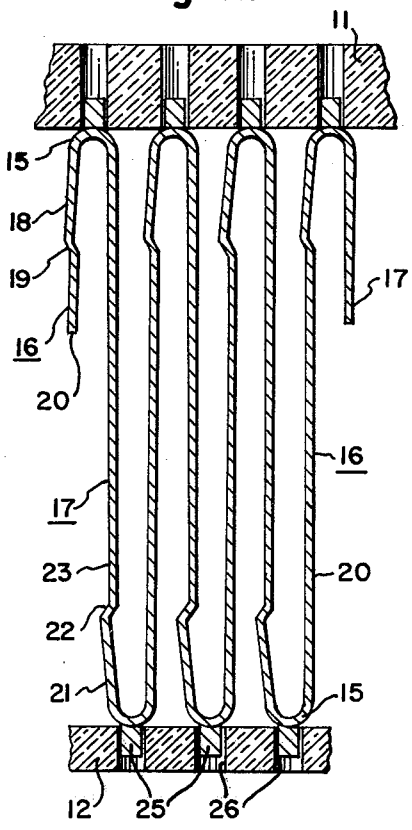
FIG. 2 is an enlarged detail of FIG. 1.
Figure 1:
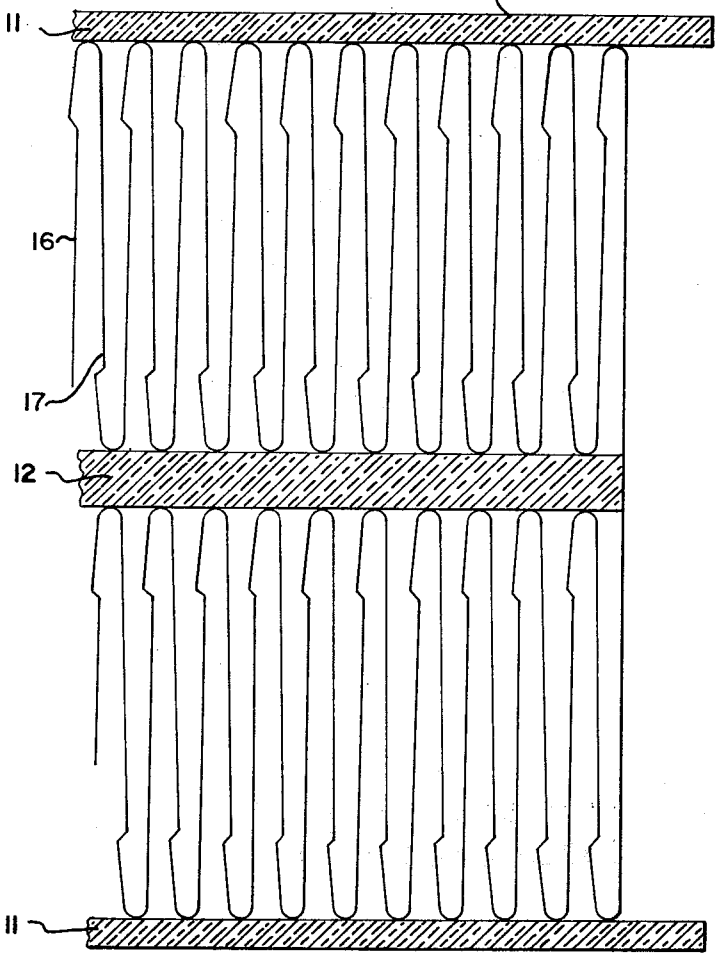
FIG. 1 is a partial plan of a single resistor unit of our invention.

Resistor unit 10 comprises a pair of parallel side support frame members 11 and a central support member 12 parallel thereto, the members being joined at each end by cross members 13 to form a flat rectangular frame. Members 11 and 12 are made of insulating material. A ribbon of resistance material is looped back and forth between each side support member 11 and central support member 12 in fan folds having more or less semi-circular end loops 15 connected with each other by lengths of ribbon 16 and 17. Each loop end 15 is affixed to a projecting stud 25 which fits into a hole 26 in side member 11 or center member 12, as is shown in Kirilloff U.S. Pat. No. 3,858,149 previously mentioned. Each ribbon length 16 comprises a minor portion 18 adjacent side support member 11 connected with a major portion 20 by a reverse bend or offset 19 which offsets the two portions from each other. The other end of major portion 20 connects with an end loop 15. Lengths 17 alternate with lengths 16. Each length 17 comprises a minor portion 21 adjacent center support member 12 connected with a major portion 23 by a reverse bend or offset 22 which offsets the two portions from each other. Adjoining major portions 20 and 23 are parallel but adjoining minor portions 18 and 21 are not parallel.

Figure 5:
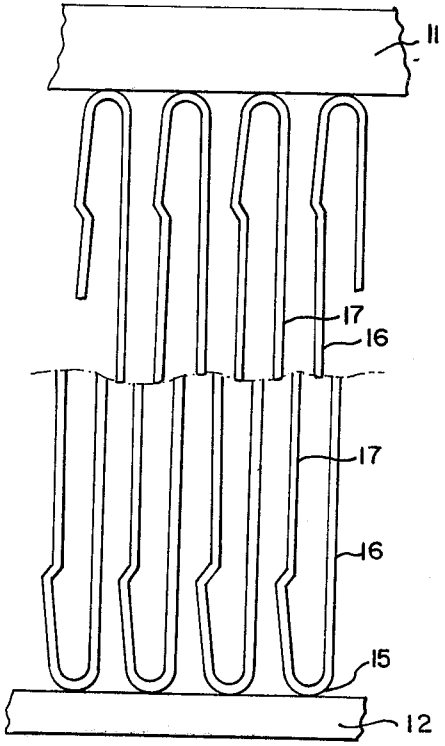
FIG. 5 is a detail in plan of a modified structure of FIG. 4, broken away in part to show a staggered relationship between the stacked units.
Figure 4:
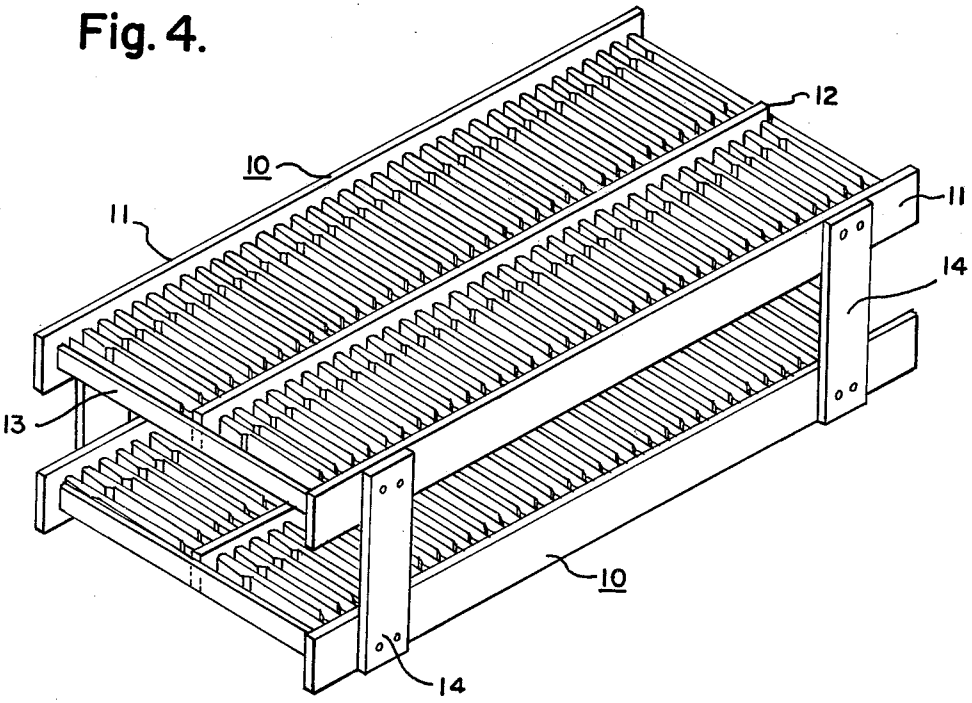
FIG. 4 is an isometric view of two units of FIG. 1 stacked one above the other.

Two or more resistor units 10 may be stacked as shown in FIG. 4 and connected by members 14 to form a grid. Conventional resistor units are stacked with parallel lengths of ribbon in line, one above the other. We may also stack our resistor units in that way. We have found, however, that it is advantageous to stack units 10 with the folds of the respective units offset from each other along the center line of center support 12, as shown in FIG. 5, so that lengths 17, for example, of an upper unit 10 overlie the space between lengths 16 and 17 of a lower unit 10.

We find that the transverse bends 19 and 22 in the resistance ribbon of our unit minimize slacking off of the folds of ribbon upon heating, and in that way reduce the likelihood of shorting between adjoining folds resulting from vibration of the unit. It is desirable to position those bends so that the major length of each fold is three or four times as long as the minor length, but the proportion is not critical. It is also desirable to have the transverse bends of adjoining folds face in the same direction lengthwise of the unit. We also find that the heat dissipation of stacked units of our invention, either by natural or by forced draft, is superior to that of conventional stacked units. The turbulence of the air passing through stacked units appears to be increased by the offsets in the loops and this turbulence is further increased if the stacked units are offset longitudinally from each other as herein described.

In the foregoing specification we have described presently preferred embodiments of our invention, however, it will be understood that our invention can be otherwise embodied within the scope of the following claims.

We claim:

1. A resistance unit adapted to withstand high temperatures and mechanical vibration comprising parallel supporting means opposite from each other, supporting between them a fan-folded ribbon of resistance material at the loop ends thereof, at least some of the folds having at least one reverse bend each transversely thereof intermediate the supporting means so as to offset from each other in different planes, the portions of the fold on each side of the bend, said bend dividing the fold into major and minor lengths.

2. The resistance unit of claim 1 in which adjoining folds each have a transverse reverse bend symmetrically located with respect to the longitudinal center line between the parallel supporting means.

3. The resistance unit of claim 2 in which the major lengths of the adjoining folds are parallel.

4. The resistance unit of claim 2 in which the transverse bends in adjoining folds face in the same direction along the longitudinal center line.

5. In combination, two resistance units of claim 1, together with means for supporting the units horizontally one above the other, the units being offset along a longitudinal center line between the parallel supporting means so that the folds of the upper unit overlay spaces between the folds of the lower unit.

* * * * *